United States Patent [19]

Roeder et al.

[11] 4,262,627

[45] Apr. 21, 1981

[54] APPARATUS FOR COATING THE INSIDE OF PIPE

[75] Inventors: Charles L. Roeder, Glendale; William J. Siefert, Waukesha; Frederik Theijsmeijer, Racine, all of Wis.

[73] Assignee: Rexnord, Inc., Milwaukee, Wis.

[21] Appl. No.: 894,150

[22] Filed: Apr. 6, 1978

Related U.S. Application Data

[62] Division of Ser. No. 809,570, Jun. 24, 1977.

[51] Int. Cl.[3] ..... B05C 7/02

[52] U.S. Cl. ..... 118/318; 118/72; 118/321; 118/DIG. 10; 239/310; 239/336; 239/427.5; 239/433; 239/424; 239/426; 239/434.5; 427/233; 427/234; 427/236; 427/239

[58] Field of Search ..... 427/183, 196, 233, 234, 427/236, 239; 366/165; 118/306, 318, DIG. 10, 317, 321, 72; 239/422, 424, 426, 425, 310, 314, 336, 427.5, 433, 434, 434.5

[56] References Cited

U.S. PATENT DOCUMENTS

| | | | |
|---|---|---|---|
| Re. 24,187 | 7/1956 | Burwell . | |
| 1,618,540 | 2/1927 | Ligonnet . | |
| 1,949,433 | 3/1934 | Russell et al. . | |
| 1,986,985 | 1/1935 | Stuart et al. . | |
| 2,066,592 | 1/1937 | Wadsworth . | |
| 2,319,657 | 5/1943 | Brown . | |
| 2,348,714 | 5/1944 | Defiore | 118/318 |
| 2,433,463 | 12/1947 | Lampe | 427/196 |
| 2,495,540 | 1/1950 | Nichols et al. | 427/196 |
| 2,623,809 | 12/1952 | Myers . | |
| 2,689,801 | 9/1954 | D'Alelio | 427/201 X |
| 2,773,287 | 12/1956 | Stout . | |
| 2,880,109 | 3/1959 | Current et al. . | |
| 2,910,042 | 10/1959 | Gallmeyer et al. | 118/306 X |
| 2,962,052 | 11/1960 | Sergovic . | |
| 3,003,751 | 10/1961 | Trost | 239/336 X |
| 3,034,729 | 5/1962 | Gray et al. | 118/306 X |
| 3,107,057 | 10/1963 | Hanusch | 239/336 |
| 3,174,693 | 3/1965 | Weber | 239/434 X |
| 3,177,902 | 4/1965 | Rubenstein . | |
| 3,180,312 | 4/1965 | Handley et al. | 118/306 X |
| 3,219,472 | 11/1965 | Hucks . | |
| 3,249,665 | 5/1966 | Bearden et al. . | |
| 3,278,324 | 10/1966 | Nelson . | |
| 3,304,589 | 2/1967 | Vologdin et al. . | |
| 3,462,083 | 8/1969 | Kautz . | |
| 3,563,791 | 2/1971 | Janco . | |
| 3,804,663 | 4/1974 | Clark . | |
| 3,864,443 | 2/1975 | Hopkins | 427/201 X |
| 3,893,621 | 7/1975 | Johnson | 239/415 |
| 4,086,663 | 4/1978 | Croft | 366/165 |
| 4,169,906 | 10/1979 | Hallstrom et al. | 427/236 X |

*Primary Examiner*—Shrive P. Beck

*Attorney, Agent, or Firm*—Kinzer, Plyer, Dorn & McEachran

[57] ABSTRACT

This is an apparatus for coating the inside of a pipe with a wear-resistant material and is more specifically concerned with an improved production machine for producing large size pipe.

14 Claims, 27 Drawing Figures

PREPARATION STATION 10
PIPE
COATING STATION 12
CURING STATIONS
20
22
67
18
ABRADING PROBE 14
COATING PROBE 16

54
30
52
28
58
60
26
24
66

PIPE
62
4

PIPE

PIPE
PIPE
112
116
188
78
70
72
73
68
82
80
112
136
140
128
110
146
78
70
80
82
90
88
68
73
68
80
122
118
126
130
124
188
128
120
126
114
146
134
110

PIPE 210
212
214
234
74
236
232
238
222
196
206
224
240
208
242
194
244
228
226
230
246
248
250
204
202
198
200
68
86
106
85
108

APPARATUS FOR COATING THE INSIDE OF PIPE

This is a division of application Ser. No. 809,570, filed June 24, 1977.

SUMMARY OF THE INVENTION

This invention is concerned with an apparatus for preparing pipe coated on the inside with a wear-resistant material and is more specifically concerned with a production machine which may prepare pipe sections of substantial length, for example thirty feet, and varying diameters, for example from four inches to twenty-four inches.

A primary object is a pipe-coating apparatus in which a coating made up of matrix with wear-resistant particles therein is conveyed on a production line basis and applied to the inner surface of the pipe as it is rotated.

Another object is an apparatus of the above type in which the wear-resistant particles are of various sizes and grades.

Another object is an apparatus of the above type in which the particles are conveyed to the inside of the pipe by an air stream and are mixed at a mixing head or mixing zone at a point within the pipe with the mixing zone traversing the inner surface of the pipe.

Another object is a probe arrangement for use in the apparatus of the above type which separately conveys the resin and accelerator of the matrix to a mixing point where the matrix is formed and then the matrix is intermixed with the particles.

Another object is a production machine which, first, has a preparation station and, second, a coating station.

Another object is an apparatus of the above type which allows one pipe to be coated at the same time that another pipe is being prepared.

Another object is an apparatus of the above type in which a preparation probe and a coating probe work side by side but are arranged and controlled to work independent of each other so that they may be separately cycled.

Another object is an apparatus of the above type which will operate efficiently even though the pipe itself may be out of round and/or cambered somewhat at one point or another and is somewhat bumpy or lobular.

Another object is a centrifugal casting arrangement for making coated pipe of the above type which has a coating that enables the pipe to be turned at a relatively low rate of speed.

Another object is an apparatus of the above type which has a mixing arrangement which insures full wetting of the particles by the matrix.

Another object is a mixing nozzle which is inexpensive and replaceable in the event of excessive wear and/or clogging.

Other objects will appear from time to time in the ensuing specification and drawings.

DESCRIPTION OF THE PREFERRED EMBODIMENTS

Figures 1, 2, 3:
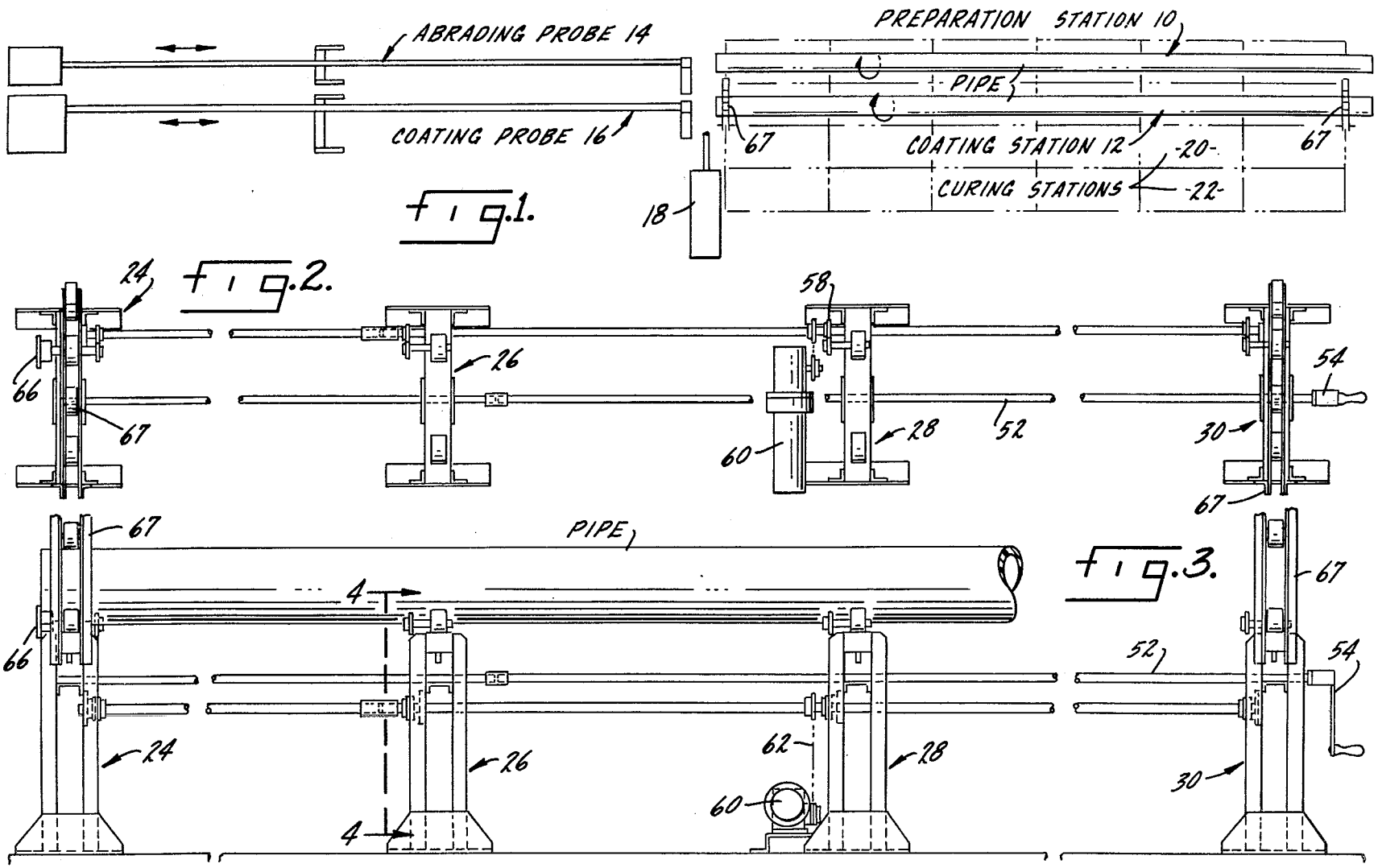
FIG. 1 is a schematic plan view of the over-all mechanism and method.
FIG. 2 is a top plan view, on an enlarged scale, of one of the stations in FIG. 1.
FIG. 3 is a side view of FIG. 2.

A schematic arrangement of a pipe-coating machine has been shown in FIG. 1 with two pipes being shown on the right opposite two probes on the left. The first pipe is at what will be referred to as a preparation station 10 with the second being at what will be referred to as a coating station 12. The first probe 14 is an abrading probe and, as will be explained in detail hereinafter, is constructed or arranged to move back and forth, as indicated by the double arrow, to prime or prepare the inner surface of the pipe at 10. The second probe 16 is a coating probe which also moves back and forth, as indicated by the double arrow, to coat the inner surface of the pipe at pipe coating station 12. A power and control console 18 is positioned more or less between the stations and probes and to one side so that all current for the various motors, etc. described hereinafter will move through cables to the center position and then either left or right to the stations and probes.

A fiber glass or steel pipe or the like is positioned, either mechanically or by hand, in the preparation station 10 and is there supported for rotation about a generally horizontal axle. The preparation probe 14 is inserted and preparation takes place as the probe is withdrawn. Thereafter the prepared pipe is shifted, either by automatic mechanism or by hand, to the coating station 12. The coating probe 16 is inserted and, as it is withdrawn, the inner surface of the pipe is coated with a wear-resistant material while the pipe is being rotated. Additional stations 20, 22, etc, may be provided to which the coated pipe may be shifted and rotation continued until the coating inside of the pipe is adequately cured to prevent sagging. But these so-called curing stations have not been shown in detail and they could be merely duplicates of the priming and coating stations.

One such station, which could be either the preparation or the coating station, is shown in detail in FIGS. 2–7. Such a station may include a series of supports 24, 26, 28 and 30, spaced from each other and suitably connected by bolting or otherwise to the floor or foundation. One such support is shown in detail in FIGS. 4–6 and may include feet 32 supporting uprights or angles 34 interconnected by braces or straps 36 with inwardly disposed inclined slides 38 on the upper end thereof with adjustable support roller units 40 and 42, each of which has a lower extension 44 that accepts a threaded rod 46 which has gears 48 on the inner ends thereof meshing with a gear 50 on a longitudinal adjustment rod 52 that may extend through all of the supports to a handle 54 at one end, as shown in FIGS. 2 and 3. Thus, rotation of the handle 54 will turn the adjustment rods or screws 46 which will move the rollers 40 and 42 together simultaneously either in or out. Adjustment of the roller unit 40 and 42 either in or out is to accommodate different size pipes, one such being shown in position in FIG. 4.

Figures 4, 5, 6, 7:
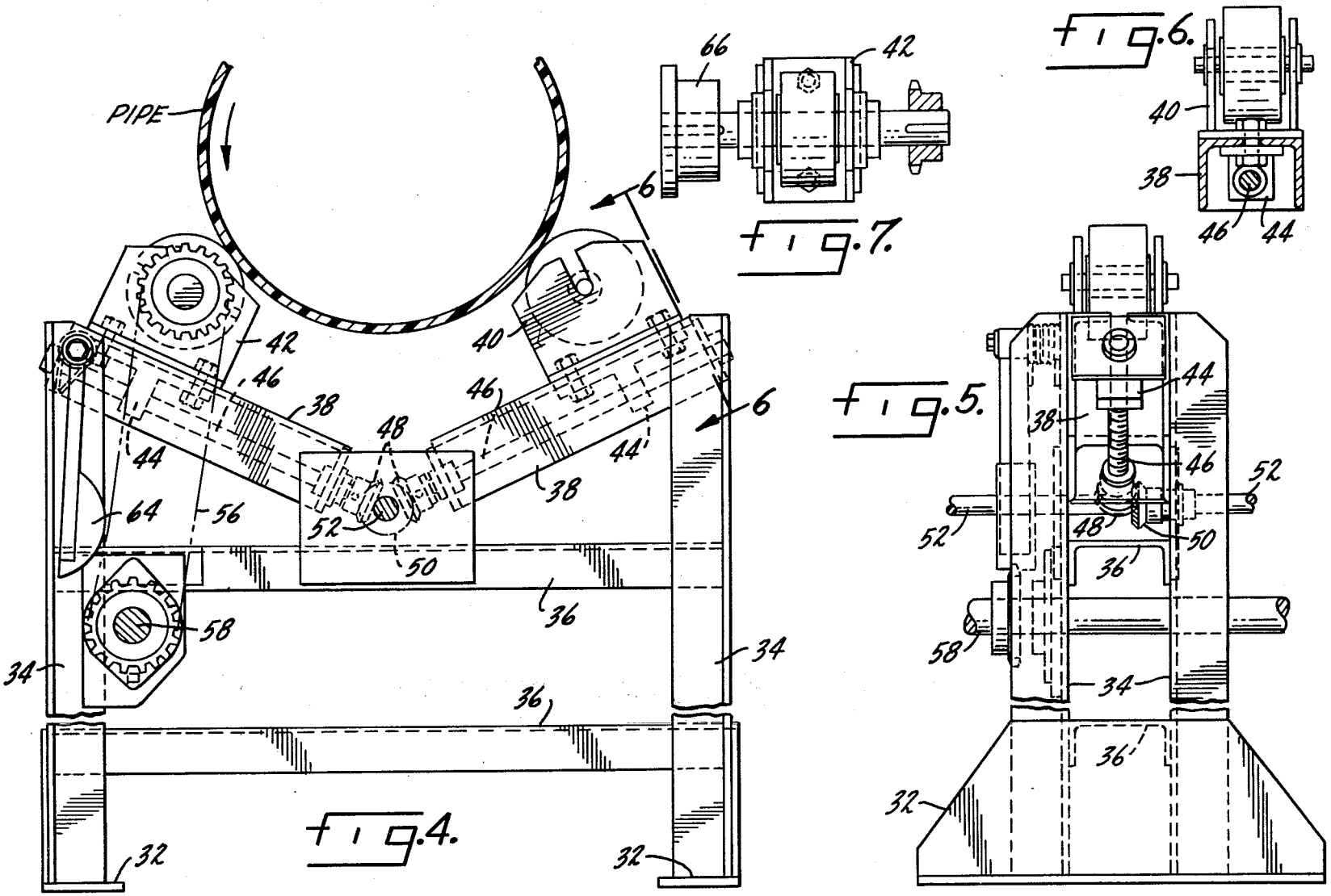
FIG. 4 is a section along line 4—4 of FIG. 3, on an enlarged scale.
FIG. 5 is a side view of FIG. 4.
FIG. 6 is a section along line 6—6 of FIG. 4.
FIG. 7 is a plan view, partially in section, of a detail of a stop wheel.

Roller unit 40 in FIG. 4 may be merely an idler, while 42 is power-driven through a chain 56 to a sprocket on a drive shaft 58 which is driven by an electrical motor 60, in FIG. 3, through a chain 62. Chain 56 is tensioned by a spring-biased idler 64 which bears against the chain to take the slack out of it in any position of the roller unit 42.

The innermost upright or support 24 may have a flanged roller 66 on one end of the power-driven support roller unit 42 which, as shown in FIGS. 2 and 3, provides an abutment for the edges of the pipe so that during withdrawal of the probe, be it the preparation probe or the coating probe, the tendency of the pipe to follow the probe will cause it to abut the flange which will keep the pipe on the station. Several of the supports may have hold-downs 67 which may be manually or mechanically applied to hold the pipe in place during preparation or coating.

Figure 8:
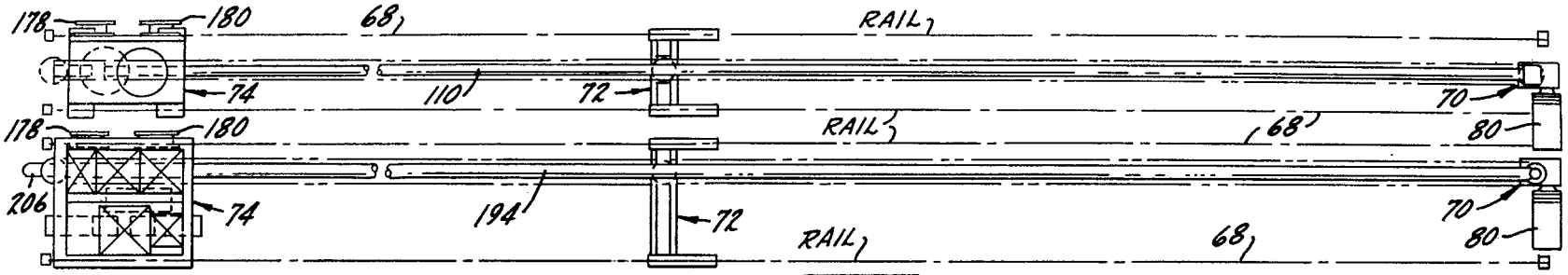
FIG. 8 is a top plan view, on an enlarged scale, of a portion of FIG. 1.
Figure 9:
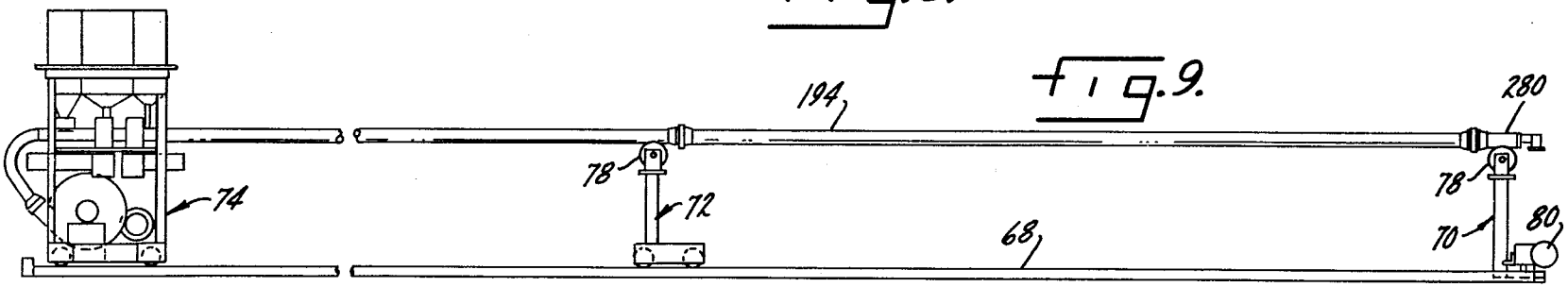
FIG. 9 is a side view of FIG. 8.

The probes are broadly shown in FIGS. 8 and 9 as side by side and it should be understood that they operate independently. They are similar in many details and, as shown in FIG. 8, the abrading probe may be somewhat narrower than the coating probe. Each includes two longitudinally disposed rails 68 along which certain parts move to and from the priming and coating stations. Each includes a fixed support 70 at the right end, at least one movable intermediate support 72 on wheels 73 which may be generally in the middle and a working unit or working mechanism 74 on wheels 75 at the left and. The operating units 74 will differ, but these details will be explained hereinafter.

Figure 10:
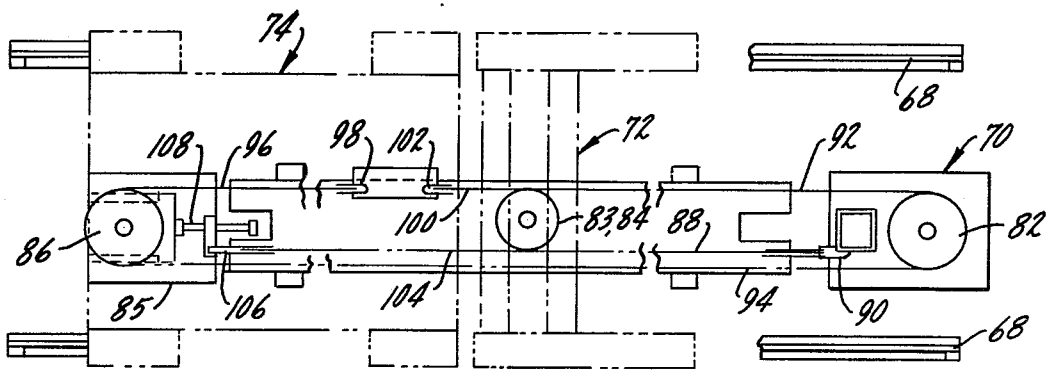
FIG. 10 is a top plan view, on an enlarged scale, of the drive feed mechanism of FIG. 8.

Both the fixed support 70 and the movable support 72 carry rollers 78 on the upper end thereof which are grooved to support the probe so that as the units move from left to right, the probe will roll along the top of the supports on the rollers. The fixed support 70 at the right end has an electric motor 80 or the like which drives a sprocket 82 on the lower end thereof, shown schematically in FIG. 10. The movable support 72 has two sprockets 83 and 84 on the bottom thereof, one above the other. At the other end a base plate 85 is affixed to the foundation or floor and carries a sprocket 86. A chain 88 is dead-ended on the fixed support 70, as at 90, and extends around the top sprocket 83 on the movable support 72, then back at 92 to the fixed support 70 where it passes around sprocket 82, then extends at 94 to the other end where it passes around fixed sprocket 86 then back, at 96, to a dead end 98 on the working unit 74. A second chain 100 is dead-ended at 102 on the working unit 74 and extends around the lower sprocket 84 on the movable support and then returns, at 104, to a dead end 106 on the fixed plate 85. Proper tension in the chains may be obtained by a suitable adjustment mechanism 108 which is constructed to move sprocket 86 to the left or right through a suitable slide mechanism.

The result of the arrangement shown is that the power source, be it an electric motor or otherwise, will rotate one of the sprockets, in this case the fixed sprocket 82. The result will be that the operating unit 74 will be either pulled to the right or the left at a certain rate of speed, to the right causing the probe to be inserted into the pipe, to the left causing it to be withdrawm from the pipe. The movable support 72 will also move either right or left but at half of the speed of the working unit 74. The result will be that the intermediate support 72 and working unit 74 will maintain a proportionate spacing and, with proper dimensioning, will both arrive at the fixed support 70 at about the same time when the probe is fully inserted in the pipe. As the probe is withdrawn, the working unit 74 will move at twice the speed of the intermediate support 72 with the result that when the working unit gets all the way to the left, to the position shown in FIGS. 1, 8 and 9, the intermediate support 72 will be roughly midway between.

Figure 11:
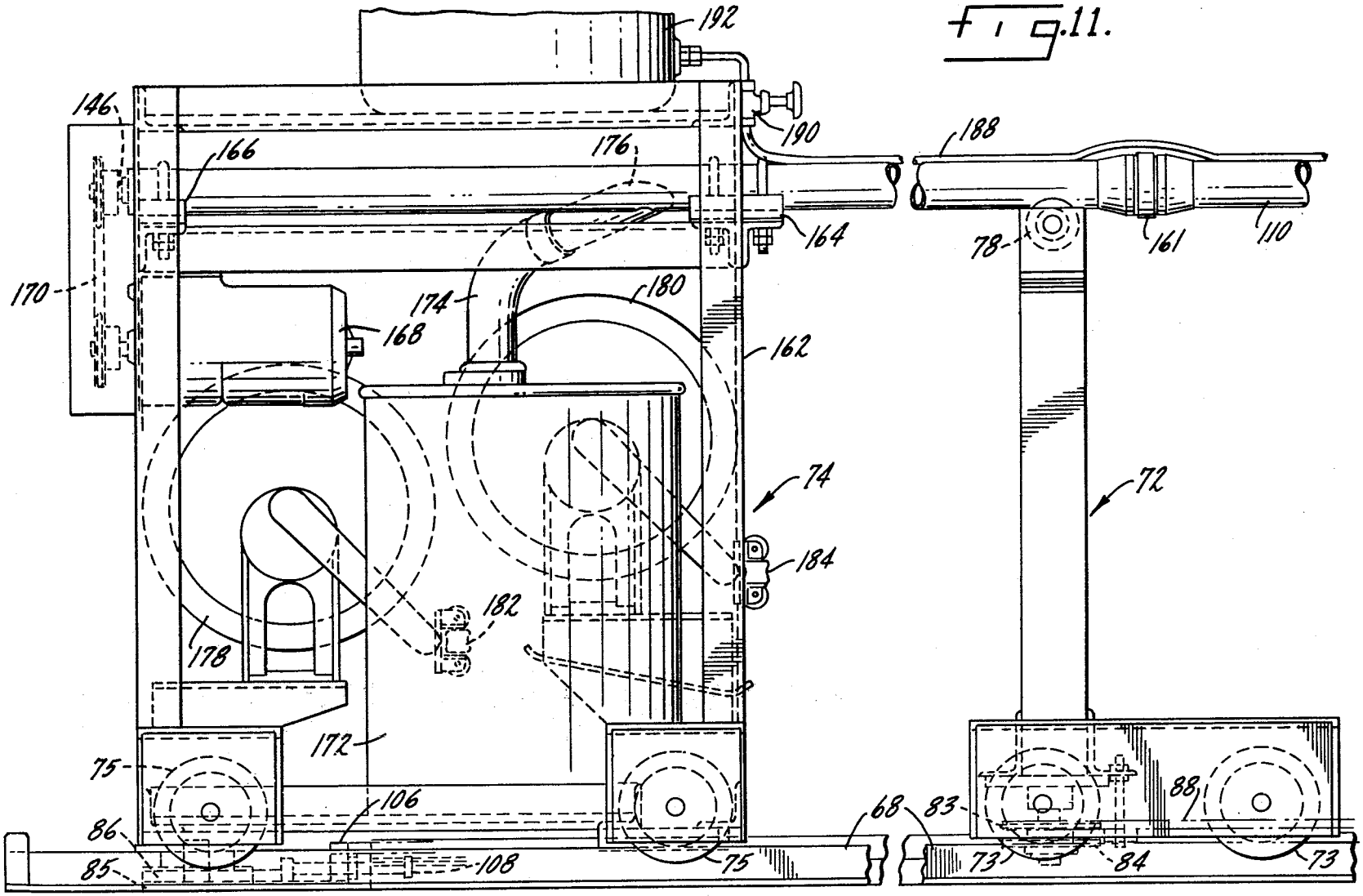
FIG. 11 is a side view, on an enlarged scale, of a part of the mechanism in FIG. 8.
Figures 11A, 12, 14:
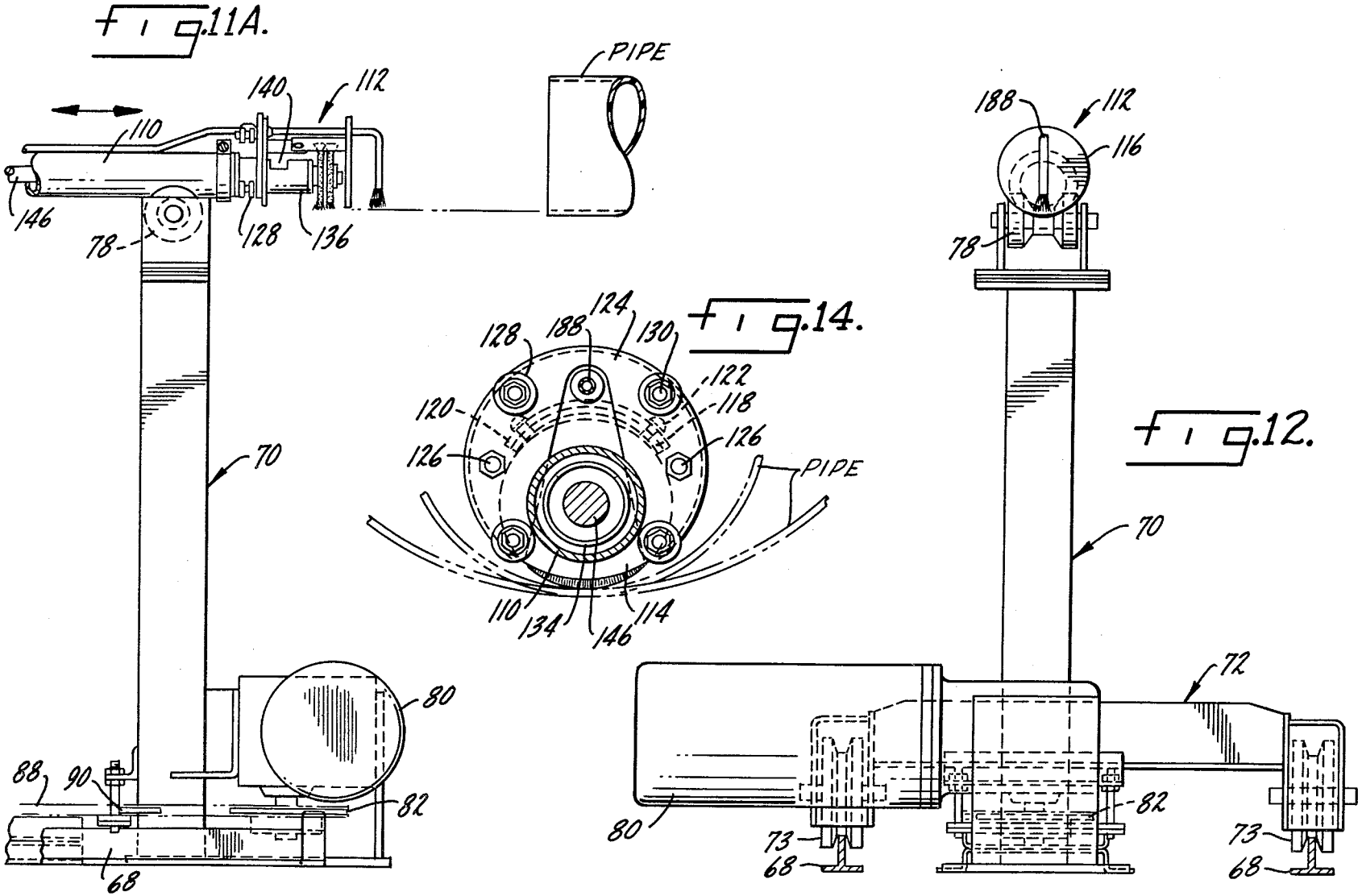
FIG. 11A is the end of the mechanism shown in FIG. 11.
FIG. 12 is an end view of FIG. 11A.
FIG. 14 is a section along line 14–14 of FIG. 13, on a reduced scale.
Figures 13, 15, 16:
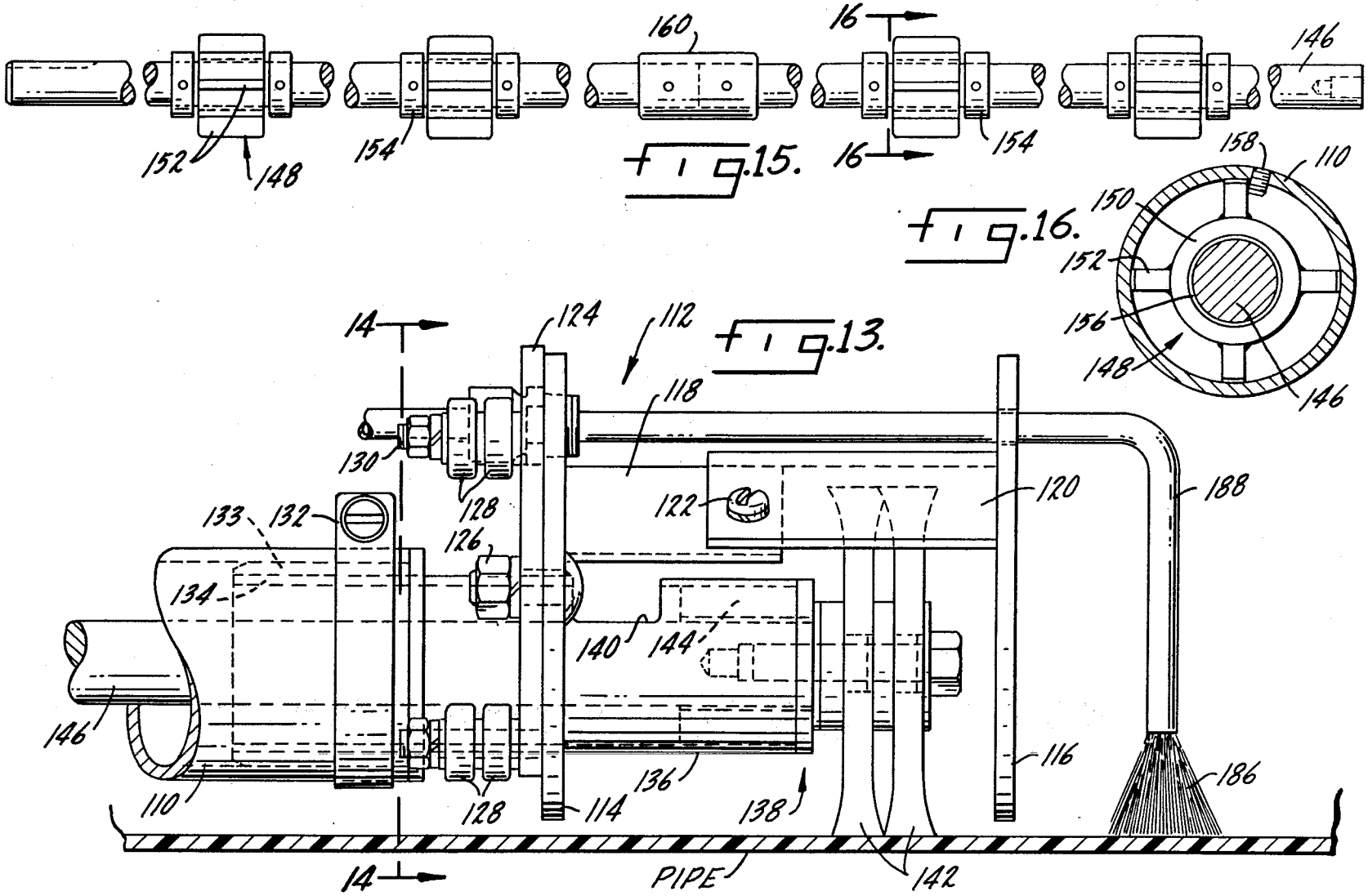
FIG. 13 is an enlargement of a part of FIG. 11A.
FIG. 15 is a side view of the internal drive mechanism of FIGS. 11–14.
FIG. 16 is a sectional along line 16—16 of FIG. 15, on an enlarged scale.
Figure 17:
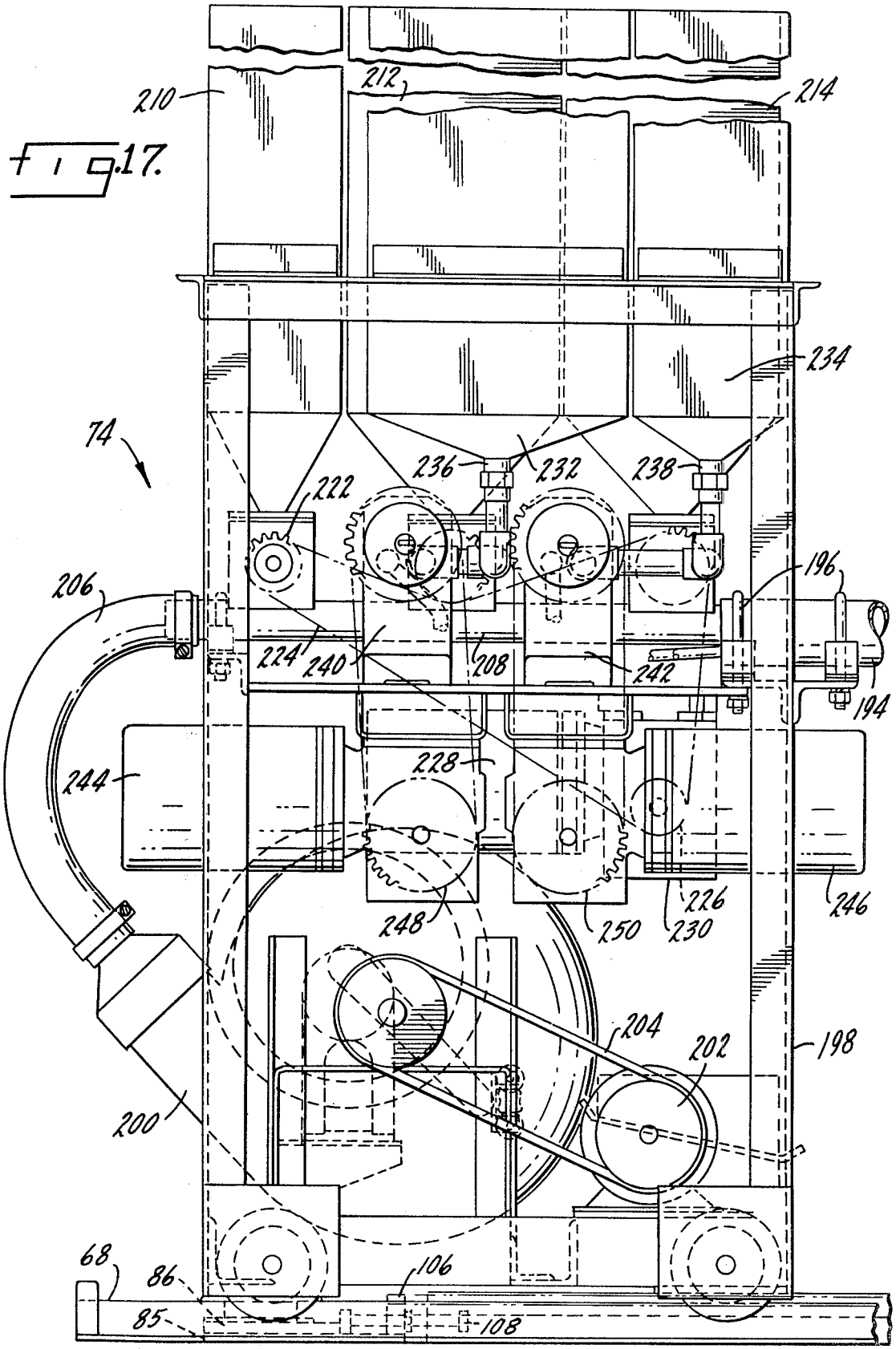
FIG. 17 is a side view of a part of FIG. 9, on an enlarged scale.

The abrading or preparation probe is shown in some detail in FIGS. 11–16 in which the probe itself is made up of a tube 110 which on the right end thereof has an abrading head 112, shown in detail in FIGS. 13 and 14. In FIG. 13 the abrading head includes spaced plates 114 and 116 interconnected by arcing overlapping plates 118,120, suitably interconnected at 122 with a backup plate 124 mounted on plate 114 by bolts 126 or the like and four pairs of rollers or bearings 128 each mounted on a stub shaft 130 and positioned about 90° apart. As shown in FIG. 14, the rollers 128 are free to rotate and project slightly beyond the edge of the plates. The pipe or tube end 110 is clamped as at 132 onto a sleeve 133 which surrounds a smaller tube 134 which extends through the plate with a portion 136 thereof disposed in the abrading chamber 138 defined by the various plates. An opening 140 in the tube provides an inlet for a source of vacuum to be described hereinafter.

One or more abrading heads, in the nature of wire brushes 142, are mounted on the end 136 of tube by a bearing 144 and are driven by a drive shaft 146 which extends back through tube 110 to the working unit 74 at the other end to be turned by a power source, to be described hereinafter. The drive shaft 146 for the wire brushes is supported at intervals by bearings shown in detail in FIGS. 15 and 16. Each such bearing 148 is made up of a sleeve 150 with a plurality of arms 152, for example four, extending outwardly therefrom to engage the inner surface of tube 110. Each such bearing is held in place by collars 154 on each side thereof which are connected to the drive shaft 146 by a setscrew or the like. A radial bearing is provided between the drive shaft and the sleeve 150 which is in the form of a cylinder 156, which may be Nylon or the like. The tube or sleeve 150 has a setscrew 158 or the like to prevent rotation of the bearing 148. The drive shaft 146 may, of course, be made in sections and coupled together, as at 160. The tube may have one or more rings or bearings 161, in FIG. 11, held in position thereon by spacers but otherwise free to rotate, which engage the inside of the pipe providing support for the probe and reducing friction.

The working unit 74 for the preparation probe may be in the form of a wheeled frame 162 which is made up of a plurality of suitably interconnected uprights and angles, none of which is important in detail. The rear end of the priming tube 110 is clamped as at 164 and 166 on the carriage with the end of the drive shaft 146 extending beyond the end thereof, as shown on the left in FIG. 11, to be driven by a suitable electric motor 168 or the like through a suitable sprocket and chain arrangement 170, all of which is mounted on the carriage.

The carriage 162 also carries a suitable vacuum cleaner 172 which is connected by an inlet horn 174 into the abrading tube 110 as at 176 so that the source of vacuum will be communicated to the inside of the tube 110 down to the inlet 140 inside of the priming chamber 138.

Carriage 162 also has two take-up reels 178 and 180 which, as shown in FIG. 11, are mounted on the far side of the carriage frame and are spring-operated to pay out or take up electric cables working from the peripheral edge thereof through guides 182 and 184. The cables themselves are not shown for sake of simplicity, though it will be understood they extend down along the side of the machine to a suitable point between the probes and the priming station, generally aligned with console 18 in FIG. 1. As the carriage 162 moves to the right in the drawing, the cables will be taken up on the reel and payed out when the carriage 162 moves to the left. The mounting, bracketing, etc. supporting these reels is not considered important and has not been shown or explained in detail.

Referring to FIG. 13, as the abrading head is moved to the left, the brushes 142 will grind or scrape the inner surface of the pipe and the particles removed therefrom will be picked up by the vacuum through opening 140. Thereafter as the working head moves to the left, a suitable fluid or priming media, may be applied to the freshly prepared surface by a brush or applicator 186 with fluid being supplied thereto through a tube 188 that extends back along the probe, as shown in FIG. 11, through a valve 190 to a tank or source of supply 192 on the carriage 162.

In FIG. 14 a portion of two sizes of pipe are shown. It will be understood that while the pipe rotates in one direction, the wire brushes rotate in the other so that the abrading head may tend to climb the wall of the tube. In this event, the rollers 128, projecting beyond the edge of the abrading head, will engage the tube wall and tend to keep the abrading head centered, the wire brushes in contact with the inner surface, and reduce such climbing tendency. While four such rollers have been shown around the periphery of the abrading head, a less number may work as well and in certain situations they may not be necessary.

The working unit 74 for the coating mechanism is shown in detail in FIGS. 17–26. The coating probe consists of a tube 194, to be explained in detail later, which is clamped, as at 196 to the carriage or frame 198 of the coating unit. The carriage or frame itself is made up of suitably interconnected angles, slats and braces which will not be explained in detail but will only be referred to where necessary hereafter. The frame is supported on wheels and moves on the rails 68, as explained previously and supports a blower 200 driven by a suitable electric motor 202 through a belt 204 or the like to supply an air current through an elbow or tube 206 which is connected to the open end of an air tube 208 that extends in the end of the probe pipe 194, shown in FIG. 17.

Figure 19:
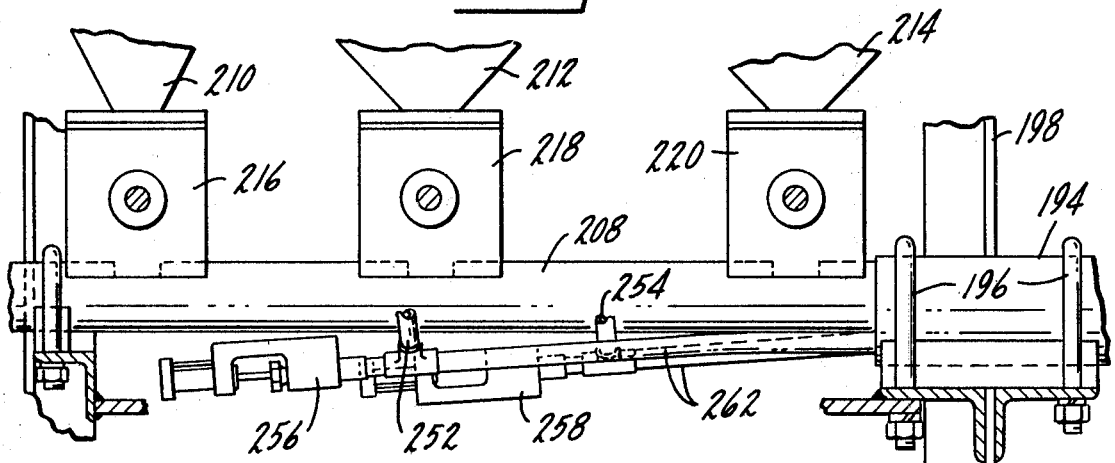
FIG. 19 is a section along line 19—19 of FIG. 18.
Figure 20:
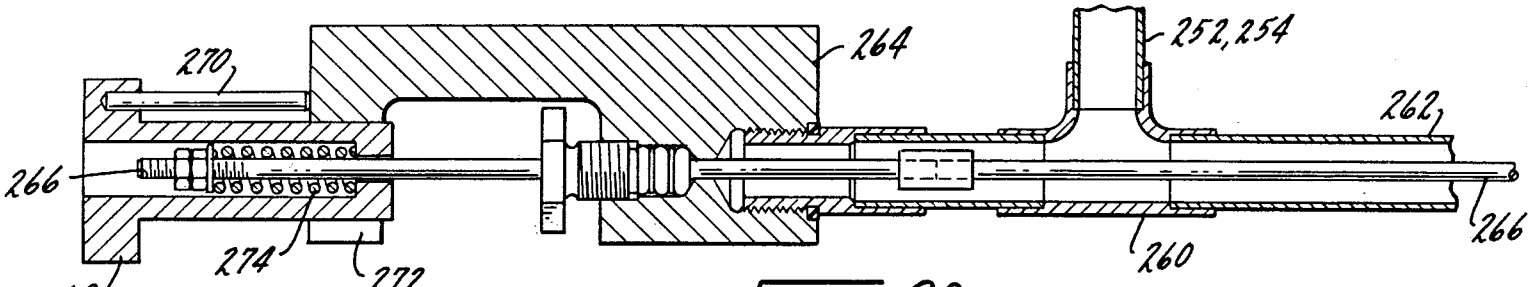
FIG. 20 is an enlargement of a part of the mechanism in FIG. 19, on an enlarged scale and in section.
Figure 21:
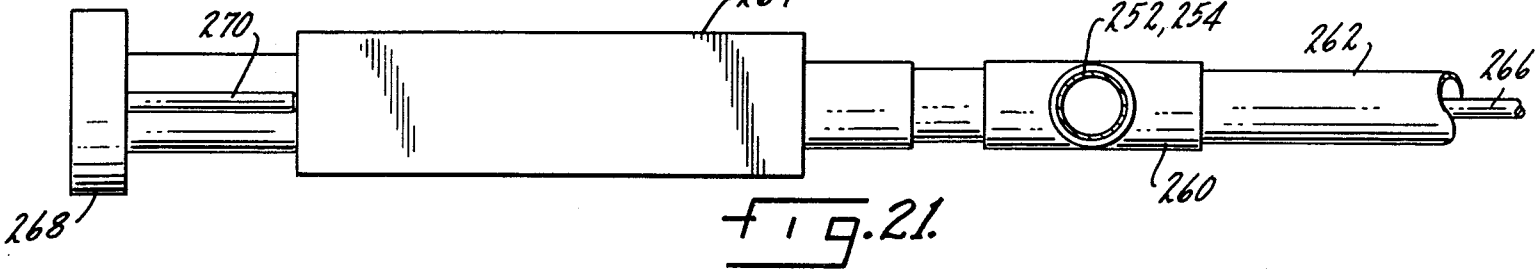
FIG. 21 is a top plan view of FIG. 20.
Figure 22:
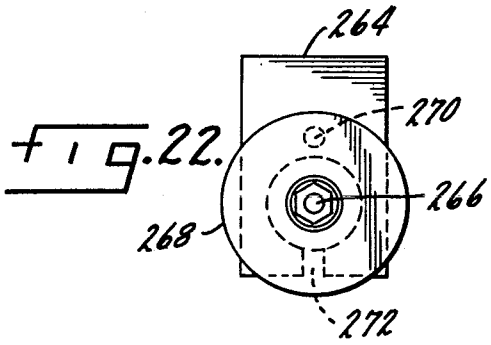
FIG. 22 is an end view, from the left end, of FIG. 20.

A plurality of bins, shown in this case as three, 210, 212 and 214, are arranged longitudinally on the frame and may be open at their upper end, with possibly a hinged cover, to accept three different sizes of wear-resistant particles which flow from the bottom thereof through valves 216, 218 and 220, in FIG. 19, into suitable openings in the top of the air tube 208. Each of the valves may be a star valve operated by a shaft and sprocket arrangement 222 driven by a chain 224, in FIG. 17, which passes from one valve to the other to a drive sprocket 226 which is operated by a suitable electric motor 228 through a gear box 230. Since all of the valves are operated by the same chain, certain ratios or proportioning of the various grades of particles may be preset. It may be desirable to pressurize the bins, for example by a tube from elbow 206, so that the pressure above and below the valves will be the same, to eliminate any chance of a tendency to reverse air flow through the valves.

Two additional bins 232 and 234 are supported on the frame of trolley 198, the larger one 232 for a resin and the smaller 234 for an accelerator. Pipes or tubing 236 and 238 extend from the bottom thereof to pumps 240 and 242 which are operated by electric motors 244 and 246 through sprockets and chains 248 and 250 so that the resin and hardener are forced through outlet tubes 252 and 254, in FIG. 19, to manual control valves 256 and 258, which may be identical or substantially the same. One such valve has been shown in detail in FIGS. 20–25 and it will be understood that this may be illustrative of both. The connecting tube, be it either 252 or 254, with the resin or hardener, connects into a T tube 260 with an outlet tube 262 that extends, as shown in FIG. 19, into the end of the coating tube 194. A valve block 264 is mounted on the other end and controls a valve rod 266 which extends down through the tube to a merging chamber and valve element, shown in detail in FIG. 24. The other end of the control rod 266 extends through the handle block 264 to a knob 268 which is free to turn in block 264 with a stop 270 abutting the end of the block. When the handle 268 is turned, the stop 270 may be aligned with an opening or slot 272, in FIG. 22, in the block which will allow the handle to move to the right in FIG. 20 under the bias of spring 274, which removes most of the spring pressure on the control rod 266.

Figures 23, 24, 25, 26:
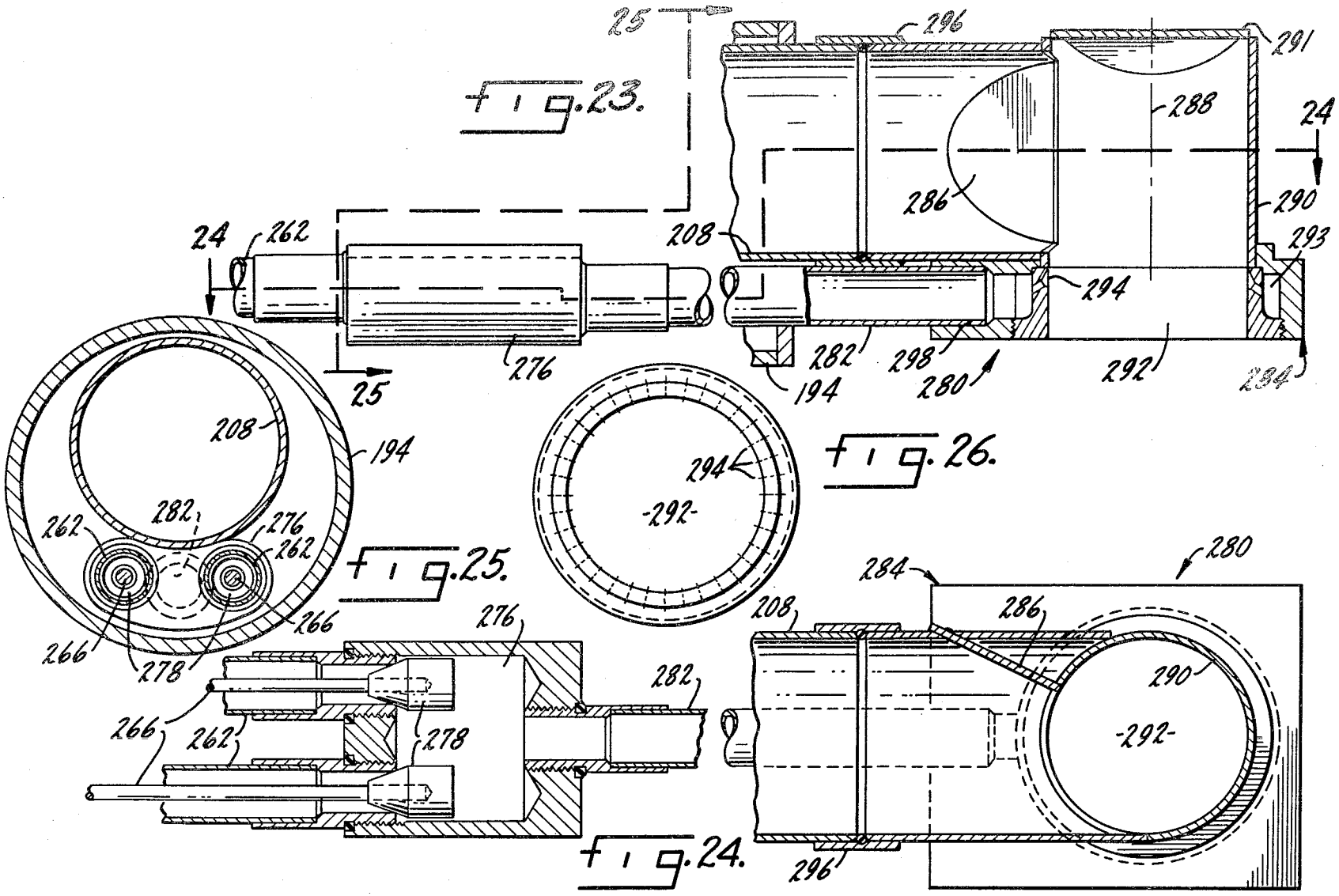
FIG. 23 is an enlargement, in section, of the mixing head, shown in FIG. 9.
FIG. 24 is a section along line 24—24 of FIG. 23.
FIG. 25 is a section along line 25—25 of FIG. 23.
FIG. 26 is a top plan view of the distributor ring in FIG. 23.

The other end of each of the supply tubes 262 is connected into a merging chamber 276, in FIG. 24, with each of the control rods 266 having a valve element or head 278 on the end thereof. When the handle 268 is in the position shown in FIG. 20, the valve head 278 will be pulled by against the seat so that the resin and hardener from the supply tube cannot flow into the merging chamber. But when the handle 268 is turned so that stop 270 slides in slot 272, most of the compression or force of spring 274 will be relieved. With handle 268 moved all the way to the right in FIG. 20, there will be some spring pressure still tending to hold the valve heads 278 in closed position, but not a great deal. The amount of spring pressure remaining serves more as a check valve and can be easily overcome by the pressure of the resin and hardener from the pumps 240 and 242 on the movable carriage.

Current may be brought to the trolley 198 by takeup reels, such as at 178 and 180, for the other trolley or cart 162, in FIG. 11.

Figure 18:
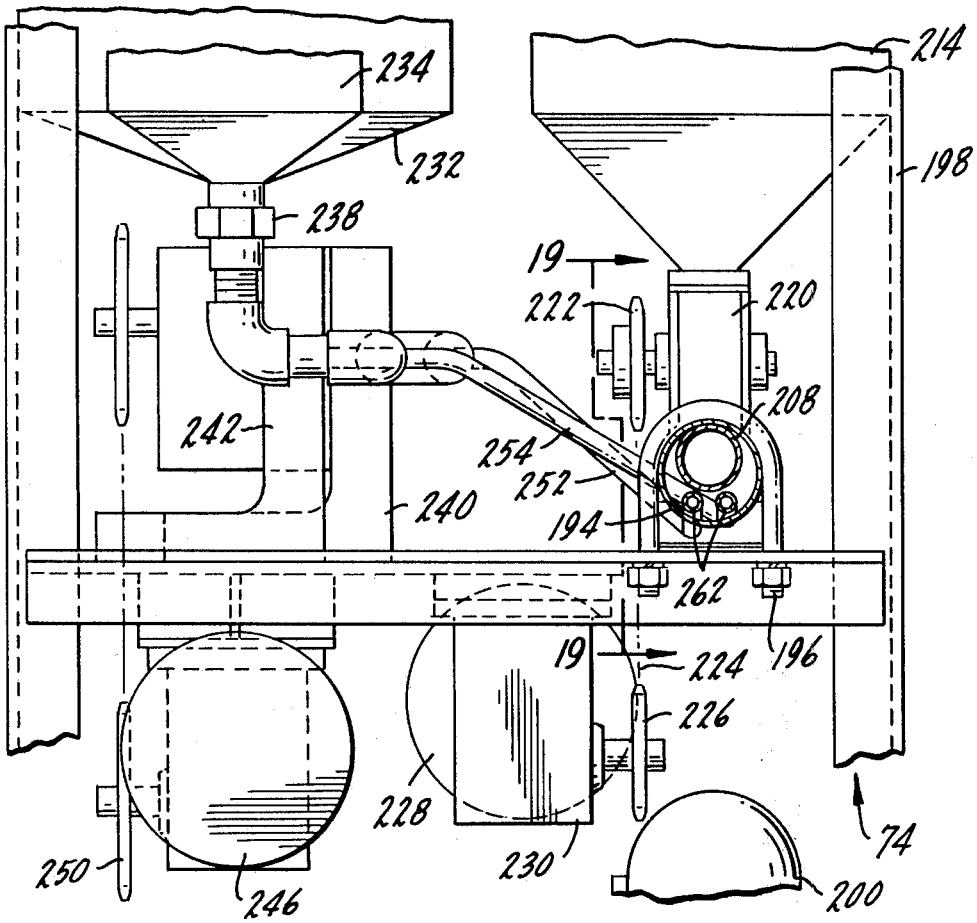
FIG. 18 is an end view, taken from the right side, of FIG. 17, on an enlarged scale.

It will be noted in FIG. 18 that the air tube 208 with the grit therein is positioned inside of the probe tube 194 with the supply tubes 262 for the resin and hardener directly underneath the air tube and bunched with it inside of the probe tube extending generally the full length of the probe to a merging chamber toward the end thereof, designated generally 280 in FIG. 9.

The merging chamber is shown in detail in FIGS. 23–26. The resin and hardener are first brought into the merging chamber 276 where they are intermixed and supplied through a linear mixer 282 to the wetting chamber or head 284 on the end of the probe. The air current tube with the particles is directly above and moves into the wetting chamber against a baffle 286 on one side thereof disposed at a suitable angle and for a suitable extent so that the air current with the particles tends to go into a swirl about the generally upright axis 288 of what may be considered a vertical cylinder 290. This tends to centrifuge the particles to the outside and the direction of motion of the air current changes from horizontal to vertical. The top 291 in FIG. 23. The mixture of resin and hardener, which is the matrix, is brought in to an annulus or chamber 293 surrounding the air current outlet 292. The annulus or chamber 293 is provided with a plurality of inwardly directed orifices or jets 294 which are disposed at suitable intervals around the full 360° circumference of the annulus. It will be noted in FIG. 23 that each of the orifices is provided with a slight upward vector so that in addition to having the matrix squirt or jet inwardly from all sides, it is also directed up slightly or somewhat counter to the downwardly moving air current, which will reduce the velocity of the particles. Also, there will be full impingement of the matrix jets upon the particles which, it will be recalled, have been centrifuged to the outside of the air swirl so that full wetting of the particles by the matrix will take place at or around the bottom or outlet of the wetting chamber. The jets of inwardly directed matrix material are also broken up or subdivided into drops or globlets by the rapidly swirling air so that an intermixture of abrasive particles and matrix drops are created which results in full wetting of the individual particles by the matrix.

The entire head or nozzle of the wetting unit is preferably detachably connected to the end of the three tubes, note the slip connection 296 for the air tube and the quick slip disconnects 298 for the matrix tube so that if the nozzle becomes worn or plugged, it can be easily removed and either cleaned or replaced. It should be borne in mind that the particles are highly abrasive. Also, the matrix material, from the time it is mixed in chamber 276, is thereafter in the process of setting up. So at the end of a cycle, the matrix system, from merging chamber 276 on to the orifices or jets 294 should be purged with either pure resin or accelerator, but not a mixture. The same thing is true at the beginning of a cycle. The linear mixer and the merging chamber 276 should be purged with mixed matrix to remove the pure resin or accelerator, whichever was used for purging at the end of the previous cycle.

The use, operation and function of the invention are as follows:

The machine is concerned with coating the inside of pipe with a wear-resistant material. The pipe may be, and at the moment is, fiber glass. But it might be otherwise, for example steel, aluminum, cardboard and so forth. At present fiber glass has the advantage that it is lightweight and strong and will accept a wear-resistant coating with a minimum of planning and preparation. But it does not necessarily matter what the wrapper is.

The coating itself is made up of a base or matrix material or bonding agent which may be considered to be a polymer and might be, for example, an epoxide polymer, unsaturated polyester (carboxylate-glycol adduct), a polyuurethane, or the like. A particular polymer found to function particularly well as the matrix is an epoxy resin. Polyepoxides having an epoxy equivalent weight of between 140 and 525 e.g. between 170 and 290 are preferred. Polyepoxides having an average molecular weight below 1200 (e.g. between 280 and 900) are preferred. They also have a functionality (i.e. ratio of molecular weight to epoxy equivalency) of at least one, preferably between 1.5 and 3.0. Suitable polyepoxides are polyepoxides formed from an epihalohydrin (for example epichlorhydrin) and a polyhydric compound e.g. bisphenol A [2,2-bis (4-hydroxyphenyl) propane] or glycerol. The preferred poly-epoxide is the polyepoxide prepared by the reaction of an epihalohydrin e.g. epichlorohydrin with diphenylolpropane (bisphenol A) which has an epoxy equivalent weight of between 175 and 210, an average molecular weight of between 350 and 400 and an OH equivalency of about 1250. A thixotropic agent may be included to the fluidity and may be varied to suit the fluidity or viscosity in the arrangement shown and might, for example, be an asbestos.

The wear-resistant particles may be of various sizes and grades and in the drawings three bins have been shown which would indicate three different sizes, large, intermediate and small. The primary particles, meaning the largest, may be metal-coated alumina ceramic particles of the type sold by Coors Porcelain Company of Golden, Colorado, under the trademark "METLX", which is a high alumina (90% type) which has very fine grain boundaries to give good abrasion resistance and may be on the order of a fraction of an inch, for example 1/16", in their largest dimension. If it is desirable to use a ceramic bead which is not specially coated, for example with a metal, a high alumina ceramic bead may be used, for example those known as "Ferro Beads", from the Ferro Corporation of Type A MINI-MEDIA made by Coors. The primary particles may be fused aluminum oxide, for example those known as EXOLON RW or RWT as manufactured by The Exolon Company of Tonawanda, New York, boron carbide, silicon carbide, silicon oxide, silicates, and so forth. Broadly, all such may be considered to be a ceramic or refractory. As to size, it is felt that something on the order of 1/16" diameter beads or 16 mesh chips are desirable, but the range may run from 36 to 8 mesh, or of that order.

The secondary particles may range in size and one of them may be, for example silicon carbide, for example in the order of 100–325 mesh. They should be about as hard as the material being handled or causing the wear, meaning the material that is impinging upon the surface that is to be protected. Silica sand, taconite, etc. may be used. An example of what may be used for the three particles is 180 mesh for the smallest, 36 mesh for the intermediate, and 12 mesh for the large chips. But this may be widely varied. Fiber glass "shorts" (1/16" to ¼"

in length) may be added as a secondary filler to reduce crack propagation and improve impact strength of the abrasion-resistant liner.

The apparatus have particular advantage where chips are being used as the primary abrasion-resistant particles in that chips, being somewhat elongated and irregularly shaped, provide a maximum surface area exposure to bond with the matrix. A sphere, for example, has the least surface area per unit of volume, so for the same volume a chip will have substantially greater exposed surface area than a sphere. Additionally, a number of factors can be coordinated and controlled so that the chips will assume a lateral or generally tangent disposition in the final hardened coating. Since the mixture is supplied from a central location to a rotating sleeve or tube in the matrix, as originally deposited the chips will have a completely random orientation. But as rotation continues during gelling, the centrifugal force involved, plus other factors, will cause the chip to assume a tangential position or nonradial orientation, either tangential or longitudinal. This can be accomplished by controlling the speed of rotation which sets the artificial gravity or the centrifugal force. Other facts bear on this, such as the length of time rotation is continued which bears on the curing time, the fluidity of the matrix itself which depends upon its compositon and makeup of the matrix, along with the various other filler particles, the size of the chips, the thickness of the coating, the temperature used or acquired during curing, etc. The result will be stratification or nonradial orientation of the chips with the other fillers randomly dispersed among them so that in use, the maximum or major dimension of the chips will be normal or effective to the flow of the abrasive slurry or whatever the coated pipe is being used for. The bond or adhesion between the chips and the matrix will be at a maximum due to the increased surface area or interface the chips provide.

The machine includes two side-by-side stations, the first being a preparatory or priming station, and the second being a coating station, with a pair of probes longitudinally aligned with the stations, the probes being constructed and arranged to operate independently of each other, although they could be synchronized. Each of the stations is constructed to support a pipe about a generally longitudinal or horizontal axis and to rotate it slowly while either priming or coating is taking place. Where the pipe is fiber glass, plastic, steel or what have you, it can be out of round somewhat and bumpy and it is important that the station cradle the pipe, but nevertheless hold it down while it is rotated so that both priming and coating may be uniform.

Fiber glass pipe normally arrives with a coating on the inside thereof which is in the nature of a release agent that is used in the fiber glass mold. This release agent should be removed, otherwise it will reduce or eliminate the adhesion of the coating to the pipe wall. Coatings or scale on the inside of other types of pipes can be a problem. Thus the cleaning priming probe is inserted all the way into the pipe so that it starts at the far end. As the probe is slowly withdrawn, the pipe is rotated and the wire brushes, be there one, two or three, abrade the inner surface with the vacuum down the probe removing the particles. Removal of release agents, scale, or process oils may be achieved by use of a nonflammable industrial solvent. The primer may be applied by the brush or applicator which may be an unfilled epoxy/amidolamine blend in a suitable solvent which may contain a coupling or adhesive agent. Priming will enhance adhesion between the matrix and the inner surface of the pipe during the coating step and will also enhance adhesion between the matrix and the particles. Instead of wire brushes, buffing wheels might be used. A fiber glass pipe of this type, for example 30 ft. in length and 10 inches in diameter may weigh something on the order of 150 pounds. After priming, it can be easily moved by hand to the coating station, although automatic equipment may be used.

The operation of the coating probe is similar in that it is inserted all the way down the pipe with coating starting at the far end and uniformly applied as the pipe is rotated and the probe is slowly withdrawn. In the coating probe all of the components are separately conveyed or moved to the end thereof. The abrasion-resistant particles are intermixed in an air stream and conveyed the full length to a swirl zone. The resin and hardener are pumped in separate channels to a merging zone where they are intermixed and curing starts. Then the curing matrix is brought into an annulus and injected inwardly throughout the full 360° thereof, with the particles passing through the annulus. The air stream of particles is swirled for two reasons. First to change the direction of movement generally 90° and, secondly, to centrifuge the particles to the outside so that as the swirl moves downwardly, the particles on the outside must pass through the curtain of matrix injected inwardly which insures full and complete coating and wetting of the particles by the matrix. It is preferred that the matrix jets have a slightly upward or countercomponent to the direction of movement of the air stream so that the velocity of the particles will be canceled somewhat. The particles are relatively heavy and while air conveying is normally limited to light material, heavier particles will require a greater volume and higher velocity of air. A great deal of air will be coming out the end of the probe and at a high velocity, which may cause the matrix material to splatter. But disposing the matrix jets somewhat counter to the direction of the air current, the particle-velocity will be reduced a good bit and the matrix and particles will be deposited on the inner surface of the pipe without excessive splatter or disruption. Also, the air is initially moving longitudinally or axially down the pipe and then must be turned 90°, or approximately 90°, in a quite small space. It will be understood that all mixing is done inside of the pipe and certain sizes may be 4" I.D. which is quite tight. It is therefore desirable to take the air stream into a vertical swirl which simplifies the 90° turn in direction and also centrifuges the particles to the outside. Thereafter the air stream moves downwardly with the particles on the outside through the matrix annulus where the inward jets completely coat or wet the particles. There will be a concentration of matrix and particles in an annulus just inside of the jet openings where full wetting of the particles by the matrix and reduction in the particle velocity will take place simultaneously. While the turn in the air current has been shown as 90°, it should be understood that the mixing head may be tipped slightly, for example forward, so that the change will be something less than 90°.

The jets of matrix break up into individual globlets which increases the exposed surface of matrix which gives better wetting or more available surface for wetting the various particles. Wetting of the individual particles by the matrix is extremely important in insuring that the particles will be secured in the resultant coating and will be firmly bonded during subsequent use of the pipe.

One of the advantages of the overall machine is that it is quite simple and there are no complicated controls and automatic cycling mechanism. Thus there is very little chance for failure. As coating takes place the speed of rotation of the pipe itself is not rapid, just sufficient to hold the coating in place all the way around. For example, one gravity has been found to be effective. At the end of coating one pipe, the merging chamber for the resin and hardener should be purged with either pure resin or pure hardener, otherwise the pipe and annulus will be filled with resin that will set up. At the beginning of the coating of the next pipe, the pure material should be purged with mixed resin before coating begins. A silane coupling agent may be included in either the resin or hardener, or both, for example, if chips are used as the wearresistant particles.

While the resin and hardener may be pumped, moving the grit and particles by any sort of a pumping or forced conveyor arrangement is difficult because of the wear on the various parts involved. Thus air conveying has the advantage that the least amount of wear will take place in the air passage. The end of the probe at the wetting chamber has been made inexpensive and replaceable in the event that excessive wear occurs where the particle air current goes into a swirl. Since the resin and hardener both before and after their mixing, do not have any particles therein, they can be easily pumped. The ratio and selection of the particles and the various sizes used can be easily controlled and since the valve mechanism on the various bins are all operated together, the ratio can be easily and accurately maintained.

Whereas the preferred form and several variations of the invention have been shown and described, it should be understood that suitable additional modifications, changes, substitutions and alterations may be made without departing from the invention's fundamental theme.

The embodiments of the invention in which an exclusive property or privilege is claimed are defined as follows:

1. An apparatus for coating the inside of a pipe with a wear-resistant material which includes a resin and hardener to form a matrix material and wear-resistant particles embedded therein, the apparatus including a frame, means on the frame for supporting a pipe to be coated about a generally horizontal axis and for rotating the pipe in such position, a probe with a mixing head on one end thereof to carry the wear-resistant material inside of the pipe, means for creating relative axial motion between the probe and the pipe so that substantially the entire inner surface of the pipe may be coated, passages on the probe for separately conveying the resin, hardener and particles to the mixing head, including an airstream conveying system passage for the particles, a merging chamber on the probe before the mixing head to which the resin and hardener passages are connected so that the matrix will be formed prior to the introduction of the particles, means in the mixing head for injecting the matrix into the particle airstream in the mixing head at about 90° thereto to form the wear-resistant material, and an outlet for the mixing head so that the material will be deposited on the inside of the pipe.

2. The structure of claim 1 further characterized by and including means in the mixing head for creating a vertical swirl of the airstream conveyed particles so that the particles will be centrifuged to the outside of the airstream, and an injection system for the matrix material on the mixing head surrounding the airstream conveying system passage for the particles and downstream from the vertical swirl-creating means and arranged to inject the matrix material inwardly into the swirl throughout approximately the full 360° extent thereof to create an intermixture of matrix and particles.

3. The structure of claim 1 further characterized by and including a matrix-injection system on the mixing head for injecting the matrix into the particle airstream with a vector at least partially counter and therefore opposite to the direction of movement of the particle airstream to thereby reduce the velocity of the particles and, at the same time, to create an intermixture of matrix material and particle.

4. An apparatus for coating the inside of a pipe with a wear-resistant material which includes a resin and hardener to form a matrix material and wear-resistant particles embedded therein, the apparatus including a frame, means on the frame for supporting a pipe to be rotated about a generally horizontal axis and for rotating the pipe in such position, a probe with a mixing head on one end thereof to carry the wear-resistant particles inside of the pipe, means for creating relative axial motion between the probe and the pipe so that substantially the entire inner surface of the pipe may be coated, passages on the probe for separately conveying the matrix material and particles to the mixing head, including an airstream-conveying system passage for the particles, a merging chamber for premixing the resin and hardener prior to the mixing head, a ring on the mixing head surrounding the particle air passage and to which the merging chamber is connected so that the resultant matrix material is formed into an annulus, means in the mixing head for injecting the matrix material into the particle airstream at about 90° thereto and throughout the full 360° circumference thereof to thereby create an intermixture of particles and matrix, and an outlet for the mixing head so that the wear resistant material will be deposited on the inside of the pipe.

5. The structure of claim 4 further characterized by and including means in the mixing head for creating a vertical swirl of the airstream-conveyed particles so that the particles will be centrifuged to the outside of the airstream, and an injection system for the matrix material on the mixing head surrounding the airstream conveying system passage for the particles and downstream from the vertical swirl-creating means and arranged to inject the matrix material inwardly into the swirl throughout approximately the full 360° extent thereof to create an intermixture of matrix material and particles.

6. The structure of claim 4 further characterized by and including a matrix injection system on the mixing head for injecting the matrix material into the particle airstream with a vector at least partially counter and therefore opposite to the direction of movement of the particle airstream to thereby reduce the velocity of the particles and, at the same time, to create an intermixture of matrix material and particles.

7. An apparatus for coating the inside of a pipe with a wear-resistant material which includes a resin and hardener to form a matrix material and wear-resistant particles embedded therein, the apparatus including a frame, means on the frame for supporting a pipe to be coated about a generally horizontal axis and for rotating the pipe in such a position, a probe with a mixing head on one end thereof to carry the wear-resistant particles inside of the pipe, means for creating relative axial motion between the probe and the pipe so that substantially the entire inner surface of the pipe may be coated, passages on the probe for separately conveying the matrix material and particles to the mixing head including an airstream-conveying system passage for the particles, a merging chamber for premixing the resin and hardener prior to the mixing head, means in the mixing head for creating a vertical swirl of the airstream-conveyed particles so that the particles will be centrifuged to the outside of the airstream, an injection system for the matrix material in the mixing head surrounding the airstream-conveying system passage for the particles and downstream from the vertical swirl-creating means and arranged to inject the matrix material inwardly into the swirl throughout approximately the full 360° extent thereof to create an intermixture of matrix material and particles, and an outlet on the mixing head so that the mixture will be deposited on the inside of the pipe.

8. The structure of claim 7 further characterized by and including the merging chamber is on the probe before the mixing head to which the resin and hardener passages are connected so that the matrix material will be formed prior to the introduction of the particles, and means in the mixing head for injecting the matrix into the particle airstream to form the wear-resistant material.

9. The structure of claim 7 further characterized by and including passages on the probe for separately conveying the resin and hardner, a ring on the mixing head surrounding the particle airstream to which the resin and hardener passages communicate so that the resultant matrix material is formed into an annulus, and means in the mixing head for injecting the matrix material into the particle airstream at about 90° thereto and throughout the full 360° circumference thereof to thereby create an intermixture of particles and matrix.

10. The structure of claim 7 further characterized by and including a matrix injection system on the mixing head for injecting the matrix into the particle airstream with a vector at least partially counter and therefore opposite to the direction of movement of the particle airstream to thereby reduce the velocity of the particles and, at the same time, to create an intermixture of matrix material and particles.

11. An apparatus for coating the inside of a pipe with a wear-resistant material which includes a matrix and wear-resistant particles embedded therein, the apparatus including a frame, means on the frame for supporting the pipe to be coated about a generally horizontal axis and for rotating the pipe in such a position, a probe with a mixing head on one end thereof to carry the wear-resistant particles inside of the pipe, means for creating relative axial motion between the probe and the pipe so that substantially the entire inner surface of the pipe may be coated, passages on the probe for separately conveying the matrix and particles to the mixing head including an airstream conveying passage for the particles, a matrix injection system on the mixing head for injecting the matrix into the particle airstream with a vector at least partially counter and therefore opposite to the direction of movement of the particle airstream to thereby reduce the velocity of the particles and, at the same time, to create an intermixture of matrix and particles, and an outlet for the mixing head so that the thus formed material will be deposited on the inside of the pipe.

12. The structure of claim 11 further characterized by and including a merging chamber on the probe before the mixing head to which resin and hardener passages are connected so that the matrix will be formed prior to the introduction of the particles.

13. The structure of claim 11 further characterized by and including a ring on the mixing head surrounding the particle air passge to which the matrix passage communicates so that the matrix will be formed into an annulus, means in the mixing head for injecting the matrix material into the particle airstream at about 90° thereto and throughout the full 360° circumference thereof to thereby create an intermixture of particles and matrix.

14. The structure of claim 11 further characterized by and including means in the mixing head for creating a vertical swirl of the airstream-conveyed particles so that the particles will be centrifuged to the outside of the airstream, and an injection system for the matrix on the mixing head surrounding the air stream-conveying system passage for the particles and downstream from the vertical swirl-creating means and arranged to inject the matrix inwardly into the swirl throughout approximately the full 360° extent thereof to create an intermixture of matrix and particles.

* * * * *